United States Patent [19]

Gustafsson

[11] 4,370,772

[45] Feb. 1, 1983

[54] DEVICE FOR GENTLE TREATMENT OF SPHERICAL BALLS

[75] Inventor: Berth U. Gustafsson, Österskär, Sweden

[73] Assignee: Projectus Industriprodukter AB, Bromma, Sweden

[21] Appl. No.: 262,068

[22] PCT Filed: Feb. 9, 1979

[86] PCT No.: PCT/SE79/00028

§ 371 Date: Sep. 18, 1980

§ 102(e) Date: Sep. 18, 1980

[87] PCT Pub. No.: WO80/01664

PCT Pub. Date: Aug. 21, 1980

[51] Int. Cl.[3] ..... B08B 1/04; B24B 11/06

[52] U.S. Cl. ..... 15/97 R; 15/21 A; 51/130; 134/6; 134/25.4; 134/33; 134/151; 134/165

[58] Field of Search ..... 134/6, 32, 33, 25.1, 134/25.4, 151, 165, 198, 82, 83; 51/130; 15/21 A

[56] References Cited

U.S. PATENT DOCUMENTS

| | | | |
|---|---|---|---|
| 846,160 | 3/1907 | Strain | 15/21 A |
| 1,176,099 | 3/1916 | Rockwell | 51/130 |

FOREIGN PATENT DOCUMENTS

| | | | |
|---|---|---|---|
| 526493 | 11/1976 | U.S.S.R. | 51/130 |
| 636048 | 12/1978 | U.S.S.R. | 15/21 A |

*Primary Examiner*—Arnold Turk

*Attorney, Agent, or Firm*—Birch, Stewart, Kolasch & Birch

[57] ABSTRACT

Method and device for treatment of balls, in particular balls for rolling bearings, by gentle mechanical treatment in the presence of a cleaning fluid or the like. According to the invention, the treatment of the entire surface of each ball is accomplished in that the balls are moved between two mutually rotating discs (12,24) while being forcedly guided (19,20) in a spiral path outwardly from the center while skidding.

13 Claims, 6 Drawing Figures

DEVICE FOR GENTLE TREATMENT OF SPHERICAL BALLS

BACKGROUND AND SUMMARY OF THE INVENTION

The invention relates to a method and a device for treatment of substantially spherical balls, in particular metal balls, such as steel balls for rolling bearings, by gentle mechanical treatment in the presence of a treatment fluid, particularly a cleaning liquid.

In order to efficiently clean steel balls, which have previously been mechanically treated so as to obtain an exact spherical shape, it is insufficient to merely wash the balls in a liquid bath. In addition thereto, a certain, yet gentle mechanical treatment is necessary, e.g. by brushing or rubbing with a soft material, so that even solid impurities are removed from the surfaces of the balls.

The DE Offenlegungsschrift No. 2 262 292 discloses a device wherein rolling bearing balls are treated between two discs or plates rotating eccentrically and in opposite directions and both being provided with a soft cushion of foamed plastic or the like. Hereby the balls will roll out spirally from the centre. However, it has turned out that the balls spontaneously roll about an axis which is parallel to the plane of the plates, and therefore the balls are not being treated around the entire surface, since the cap-shaped surface portions around said axis never touch the foamed plastic covered discs. In order to eliminate this draw-back, the known device is provided with recesses in the foamed plastic cushion of the upper plate. The diameter of these recesses is greater than that of the balls, the idea being that the balls on their way out towards the periphery shall randomly reach and temporarily stay in at least some of these recesses, whereby they will hopefully change their orientation before re-entering and rolling on between the foamed plastic layers of the plates.

One disadvantage with this arrangement is that the balls can get stuck in a recess and remain there until they are pushed away by another ball, whereby the surfaces of the finished balls can be damaged. Furthermore, there is no guarantee that the balls will re-orient themselves in the recesses.

The object of the invention is therefore to achieve a reliable method and device ensuring every ball to become uniformly fluid-treated over its entire surface and to be kept separated from the other balls during the process.

An important basic feature is thus to let the balls move between two mutually rotating discs while being forcedly guided along a spiral path with such a skidding that each ball is forced to rotate around an axis that constantly changes its direction, whereby the entire surface of the ball will be treated. Furthermore, a well-controlled transport of the balls one by one is made possible along the respective spiral guide. Thereby, the balls can be separated from each other and they will not hit each other or any of the walls in the apparatus. All the time, the balls contact the two discs as well as the spiral guide, partly by rolling engagement and partly while skidding.

BRIEF DESCRIPTION OF THE DRAWINGS

The invention will be described further below with reference to the attached drawings illustrating a preferred embodiment of a device according to the invention.

DETAILED DESCRIPTION OF THE INVENTION

Figure 1:
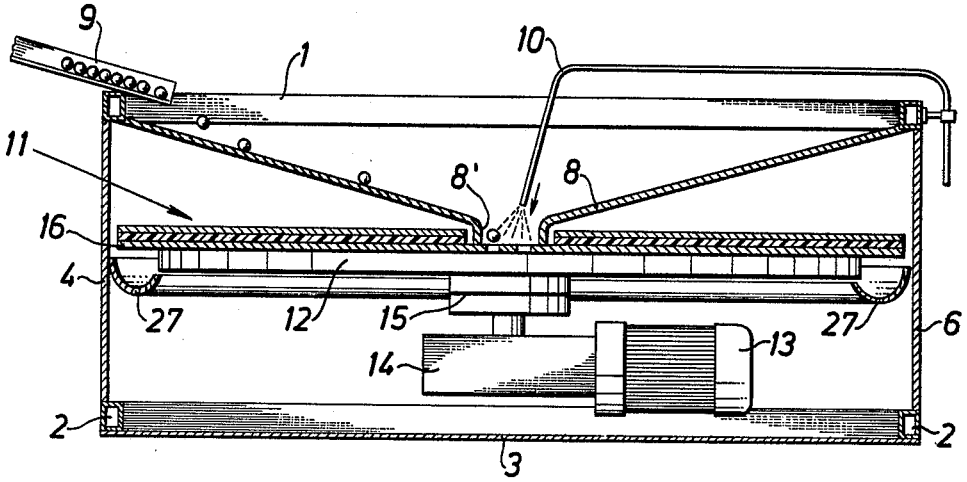
FIG. 1 is a central vertical section through an apparatus made in accordance with the invention.

The apparatus shown in FIG. 1 comprises a box-shaped casing with an upper, square frame 1, a lower, likewise square frame 2, a bottom wall 3 and four sidewalls 4–7, of which only the sidewalls 4 and 6 are visible in the section according to FIG. 1.

At the upper frame 1 a rather flat feed funnel 8 covered with nitrile rubber is arranged. Rolling bearing balls k are fed to the funnel via a schematically shown feeding chute 9, and a cleaning liquid of the above-mentioned kind is simultaneously supplied via a pipe 10. The central, cylindrical output portion 8' of the funnel 8 is introduced into the centre of a ball treatment unit 11 disposed horizontally in the casing. This unit comprises a stationary upper part serving as a counter-support and guiding member, as well as a rotating lower part in the form of a disc 12 serving as a roller bed for the balls, the disc 12 being driven by a motor 13 via a gear 14 and a sliding clutch 15.

Figure 4:
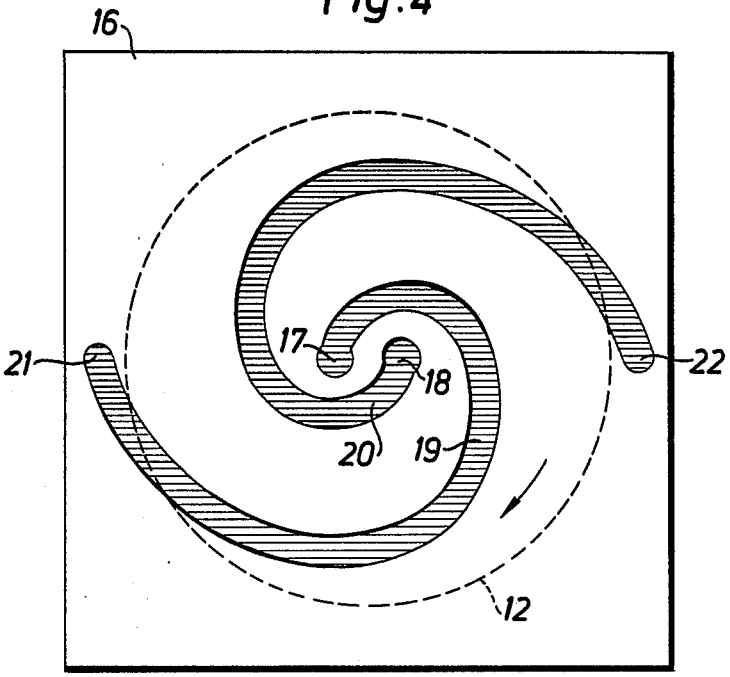
FIG. 4 is a horizontal view of a guiding plate with guide slots included in the ball treatment unit.

As the balls k enter the output portion 8' of the funnel they hit the top side of a stationary guiding plate 16 included in the upper part of the ball treatment unit 11 (see also FIG. 4) and enter the somewhat expanded feed end 17, 18 of either one of two spiral slots 19, 20 extending in parallel to each other, although circumferentially displaced about half a spiral turn, to the respective discharge end 21, 22 outside the edge of the supporting rotating disc 12. The guiding plate 16 is preferably made of a material with low friction, such as bakelite or some suitable plastic material, e.g. tetrafluorethylene.

Figure 2:
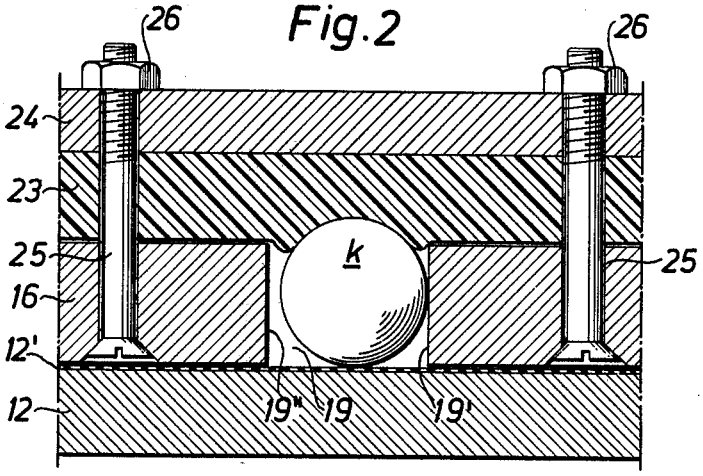
FIG. 2 illustrates in a vertical section and in a larger scale a portion of a ball treatment unit, included in the apparatus according to FIG. 1.

During the passage of the balls through each spiral slot, the actual cleaning of the balls takes place. As can be seen more clearly from FIG. 2, the ball k has a certain transversal play between the opposed sidewalls 19', 19'' of the slot 19 because the spiral guiding groove is wider than the diameter of the balls. The ball constantly engages the rotation disc 12' secured to the disc by an adhesive and consisting of a cloth or tissue of a suitable material such as rubber, plastic or textile. The rolling engagement of the ball is accomplished by means of a resilient, cushioned counter-support 23 of foamed plastic or some other soft and elastic material, possibly provided with a plastic foil in order to achieve a desired, fairly low friction with respect to the balls. The resilient counter-support 23 is kept in place and is partly pressed into the slot 19 by an upper pressure-plate 24 secured to the guiding plate 16 by several screws 25 and nuts 26, the screws extruding through the guiding plate, the foamed plastic cushion and the pressure-plate.

Thus, at a certain moment the foamed plastic cushion 23 contacts a cap-shaped part of the surface of the ball. However, the ball rolls with a certain skidding partly on the disc 12, partly on one sidewall 19' of the slot 19, whereby the rotational axis of the ball constantly changes its direction, and eventually the foamed plastic cushion 23 has gently cleaned the entire surface of the ball.

Figure 3:
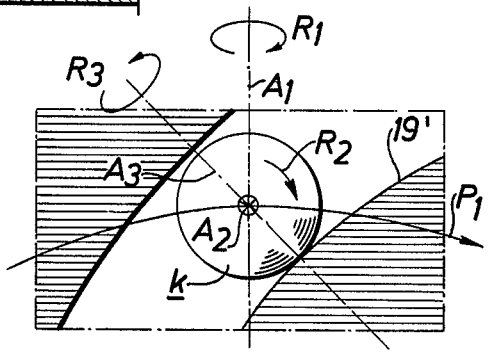
FIG. 3 is a horizontal section of the portion shown in FIG. 2.

FIG. 3 illustrates the different rotary moments acting on the ball k in the slot 19 during the rotation of the disc 12. Under the influence of the rotary motion of the disc 12 (arrow $P_1$) a rotary moment $R_1$ is excerted around an axis A, oriented radially from the centre of the disc 12. Through the rotation of the disc 12 in the direction of the arrow P, the ball k is brought into constant engagement with the radially inner sidewall 19' of the spiral slot 19, the friction (although low) between the ball k and the sidewall 19' resulting in a certain rolling engagement, which causes a rotary moment $R_2$ around a vertical axis $A_2$ (parallel to the rotary axis of the disc 12 and shown schematically in FIG. 3 with an encircled x). Simultaneously, the ball is forced to move along the longitudinal direction of the slot 19, and the rolling on the disc 12 results in a rotary moment $R_3$ around an axis $A_3$, which, like axis $A_1$, is parallel to the plane of the disc 12 although perpendicular to the tangent of the slot 19.

Provided that the friction with respect to the slot-wall 19' is not quite negligible as compared to the friction with respect to the disc 12, all three rotary moments $R_1$, $R_2$, $R_3$ will influence the ball k and, consequently a perfect rolling cannot be maintained simultaneously on the slot-wall 19' and the rotating disc 12. In practice, a certain skidding will occur at the same time or alternately on the two surfaces 19', 12'. Thereby the resultant rotational axis of the ball k will continuously change in various directions (since the three moment axes define a three-dimensional space). During the passage through the slot 19, the rotating ball k will contact the foamed plastic cushion 23 with constantly different, substantially zone-shaped surface portions, so that the entire surface becomes treated several times during the process and thus becomes uniformly cleaned through the combined effect of the cleaning liquid (which by influence from the rotating disc 12 also flows along the spiral slots 19 and 20) and the gentle mechanical treatment by the foamed plastic cushion.

Although the balls are fed close to each other into the slots 19 and 20, the constantly increasing radius results in that each ball will accelerate in relation to the next one, so that the balls are effectively separated and prevented from hitting each other throughout the entire process.

When a ball reaches the outermost portion of the spiral slot 19 or 20, respectively, outside the edge of the rotating disc 12 at each discharge end 21, 22 (see FIG. 4), the ball falls down into a substantially annular collecting chute 27 placed below the outer edge of the disc 12 (see FIG. 1). The cleaning liquid flowing out from the discharge ends 21, 22 of the spiral slots is also collected in this chute 27. The chute 27 has a sufficient inclination so as to cause the balls to roll and the cleaning liquid to flow down to the end (not shown) of the collecting chute, said end being preferably connected to one or more finishing stations (arranged in series), e.g. for the separation of the cleaning liquid and the treatment of the balls with a de-watering liquid and thereafter with an anticorrosive oil, thereafter the balls may be stored or mounted into ball bearings.

Figure 5:
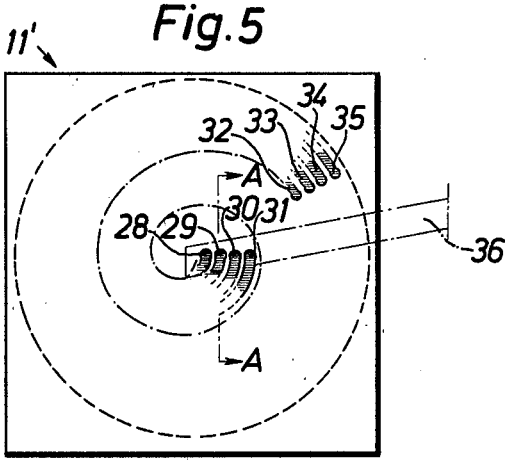
FIG. 5 and 6 illustrate a modified embodiment with a vertically arranged ball treatment unit.
Figure 6:
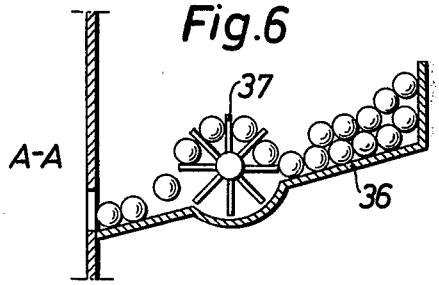

FIGS. 5 and 6 illustrate a possible modification of the embodiment of FIGS. 1–4.

The main difference consists in that the entire ball treatment unit 11' is vertically oriented. Further, the slots (in this case four) of the guiding plate are not angularly displaced, but extend quite uniformly and in parallel, one inside the other from each inlet 28–31, respectively, to each outlet 32–35, respectively. As appears from FIG. 6, the feeding into each slot can be easily achieved with an inclined chute 36, and a feed wheel 37 feeds the balls one by one to each respective slot inlet 28–31. The discharge does not create any problems either but can be achieved by collecting chutes (or one common collecting chute) connected to the outlets 32–35 of the slots. The cleaning liquid can be delivered via the feed chute 36. In other respects as well, this modified embodiment functions substantially in the same way as the above-described embodiment shown in FIGS. 1–4.

The invention may be applied and modified in several ways within the scope of the inventive idea as presented in the following claims. Thus, except for cleaning, the method can be applied and the device be modified e.g. for lapping balls by using a lapping liquid containing an abrasive.

I claim:

1. A device for gentle mechanical cleaning of substantially spherical balls in the presence of a treatment fluid, comprising:

a first and second disc being substantially parallel and rotatable relative to each other;

said discs being operatively positioned to permit balls to be cleaned to follow a spiral path between the discs while being cleaned;

said first disc including a planar frictional surface;

said second disc being provided with at least one spiral guiding groove being wider than the diameter of said balls;

a resilient counter pressure cushion being arranged in each groove of said second disc in opposite relation to said first disc to resiliently press the balls into frictional contact with said frictional surface of said first disc.

2. A device according to claim 1, wherein said second disc is stationary and said first disc is rotatably mounted.

3. A device according to claim 2, wherein said first disc is provided with a frictional coating and said spiral guiding groove is constituted by a slot disposed in a guiding plate secured to said second disc.

4. A device according to claim 3, wherein said counter pressure cushion covers and is partly pressed into said slot in the guiding plate and has a relatively low friction relative to the balls.

5. A device according to claim 4, wherein the counter pressure cushion substantially consists of a soft elastic material and is provided with a surface layer with low friction relative to the balls.

6. A device according to claim 3, 4 or 5, wherein the counter pressure cushion is pressed between the slot-provided guiding plate and an outer pressure plate by a clamping means.

7. A device according to claim 1, 2, 3, 4 or 5 wherein said spiral guiding groove includes at least two spiral guiding grooves extending in parallel relative to each other.

8. A device according to claim 7, and further including a chute located below a discharge end of each spiral guiding groove for collection of cleaned balls and outflowing treatment fluid.

9. A device according to claim 7, and further including a feeding device being disposed adjacent a central inlet end of each spiral guiding groove.

10. A device according to claim 7, wherein said discs are substantially vertically arranged and a downwardly inclined feeding chute is provided with a feeding wheel for feeding the balls one by one.

11. A device according to claim 1, 2, 3, 4 or 5, wherein said spiral guiding groove includes at least two spiral guiding grooves being angularly displaced relative to each other.

12. A device according to claim 5, wherein said soft elastic material is foamed plastic.

13. A device according to claim 5, wherein said soft elastic material is foam rubber.

* * * * *